US005732917A

United States Patent [19]

Edwards

[11] Patent Number: 5,732,917

[45] Date of Patent: Mar. 31, 1998

[54] MOUNTING DEVICE FOR WIRE MANAGEMENT IN MODULAR OFFICE PARTITION SYSTEM

[75] Inventor: Larry Edwards, Muscatine, Iowa

[73] Assignee: Hon Industries Inc., Muscatine, Iowa

[21] Appl. No.: 658,351

[22] Filed: Jun. 5, 1996

[51] Int. Cl.[6] ..... A47B 96/06

[52] U.S. Cl. ..... 248/222.12; 248/222.11; 248/223.41; 248/231.81; 248/320; 411/508

[58] Field of Search ..... 248/222.11, 222.12, 248/223.41, 231.21, 231.81, 320; 411/508–510; 403/329, 384, 387, 397, 399

[56] References Cited

U.S. PATENT DOCUMENTS

| | | | |
|---|---|---|---|
| 3,191,135 | 6/1965 | Hazelquist | 248/222.12 X |
| 3,274,450 | 9/1966 | Siebold | 248/222.12 X |
| 3,379,402 | 4/1968 | Trammell | 248/222.12 X |
| 4,155,459 | 5/1979 | Marschak | 248/223.41 X |
| 4,334,659 | 6/1982 | Yuda | 248/222.12 X |
| 4,389,759 | 6/1983 | Yuda | 248/222.12 X |
| 4,618,915 | 10/1986 | Bury | 248/222.12 X |
| 4,874,147 | 10/1989 | Ory et al. | 248/223.41 X |
| 4,898,493 | 2/1990 | Blankenburg | 411/508 X |
| 5,138,116 | 8/1992 | Kabayama | 248/222.12 X |
| 5,219,406 | 6/1993 | Raz | 160/135 |
| 5,322,252 | 6/1994 | Puente | 248/222.12 |
| 5,452,184 | 9/1995 | Scholder et al. | 411/508 X |
| 5,484,175 | 1/1996 | Teich et al. | 411/508 X |
| 5,507,545 | 4/1996 | Krysiak | 248/222.12 X |
| 5,603,596 | 2/1997 | Peroni | 411/508 |

*Primary Examiner*—Wynn E. Wood
*Assistant Examiner*—Beth A. Aubrey
*Attorney, Agent, or Firm*—Jones, Day, Reavis & Pogue

[57] ABSTRACT

A mounting device for supporting data receptacles within an office partition panel of a type comprising rigid frame members interconnected by pairs of spaced parallel tube members comprises a body portion having two spaced resilient latch arms extending from a first side of the body portion, each arm having an inclined edge directed laterally outwardly of the body portion. The first side also has at least one resilient latch arm having an inclined edge directed in an opposite direction from the. direction of the inclined edges of the first two latch arms. A frame member for supporting a data receptacle is mounted to a second side of the body member. The latch arms are configured to snap into and lock between two parallel adjacent tubes of an office partition panel and, thereby, support a receptacle within the panel.

8 Claims, 5 Drawing Sheets

MOUNTING DEVICE FOR WIRE MANAGEMENT IN MODULAR OFFICE PARTITION SYSTEM

BACKGROUND OF THE INVENTION

1. Field of the Invention

The present invention relates generally to mounting devices for use in wire management in the construction of modular office partition systems, and more particularly, to mounting devices which support data termination assemblies in an easily installed and highly functional manner.

2. Description of the Prior Art

In the construction of modern office space, it has become increasingly popular to provide large open spaces and then subdivide the space without permanent walls but rather with modular office partition systems. Numerous forms of modular office partitions are available which permit the office space to be divided in various configurations for the efficient performance of the necessary office tasks. These systems are designed to be both sturdy and relatively easy to install. They also offer the opportunity to conveniently reconfigure the office space as changing needs of the business are encountered.

A typical modular office partition system comprises a plurality of panels each having a relatively rigid frame supporting either a central core or a plurality of wall tiles. The panels or tiles are often covered by a fabric which is meant to accent the decor of the office environment. These partition systems may also serve to provide support for shelving, cabinets, desk surfaces, and the like. Thus, they are usually of sturdy construction when assembled.

One desirable feature of certain modular office partition systems is wire management capability. Often in work space areas, there is a need for telephone, computer, facsimile or other communications and data transmission means requiring data cables to be brought into and terminated in or near the work space. To accommodate the management of these cables, both functionally and aesthetically, modular office partition systems are known in which cable ducts or cable spaces are provided running between adjacent partition panels to provide convenient and unobtrusive access to communications and data transmission systems. One such system is disclosed in Raz, U.S. Pat. No. 5,219,406. In that system, vertical metal frame members are connected by cross-members consisting of pairs of tubular members. A conveniently installed connector system is used to connect the tubular cross-members to the frame members. The cross-members and frame members cooperate to form highly rigid panels which are covered by suitable tile members defining hollow spaces internal to the panels. By this construction, cables may be passed through frame openings of adjacent panels and may thereby be routed into the finished office space as needed. The terminations for the data cables may be made within the panels and the panels can be suitably designed to make data connection with various electronic equipment by removing selected tiles or, in a preferred case, by hinging certain tiles and opening access to the panel interior.

Although a partition system as thus described offers considerable convenience in setting up modern office space it is desirable to provide a means for enhancing the convenience of wire management. It is further desirable to provide data and communication systems receptacles which can be used to terminate data cables in highly effective and functional manner particularly in a panel system of the type disclosed in the aforesaid Raz patent.

SUMMARY OF THE INVENTION

The present invention is an improvement in the field of office partition wire management systems by providing a device for supporting data receptacles within an office partition panel comprising rigid frame members interconnected by pairs of closely spaced parallel tube members in such a manner as to allow panel trim components, panel tiles, base rail covers, and the like, to be removed and replaced without disturbing the mounting of data receptacles and data cabling. The device comprises a body portion having two spaced resilient latch arms extending from a first side of the body portion, each arm having an inclined edge directed laterally outwardly of the body portion. The first side also has at least one resilient latch arm having an inclined edge directed laterally outwardly of the body portion in an opposite direction of the direction of the inclined edges of the first two latch arms. A frame member for supporting data receptacles is mounted to a second side of the body member. The latch arm members are configured to snap into and lock between two parallel adjacent tubes of an office partition panel and thereby support a receptacle within the panel. The frame is also designed to be used unmounted from the body member by separately snapping into slots of the lower panel frame member when a bottom mounted receptacle is desired.

BRIEF DESCRIPTIONS OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENTS

Figure 1:
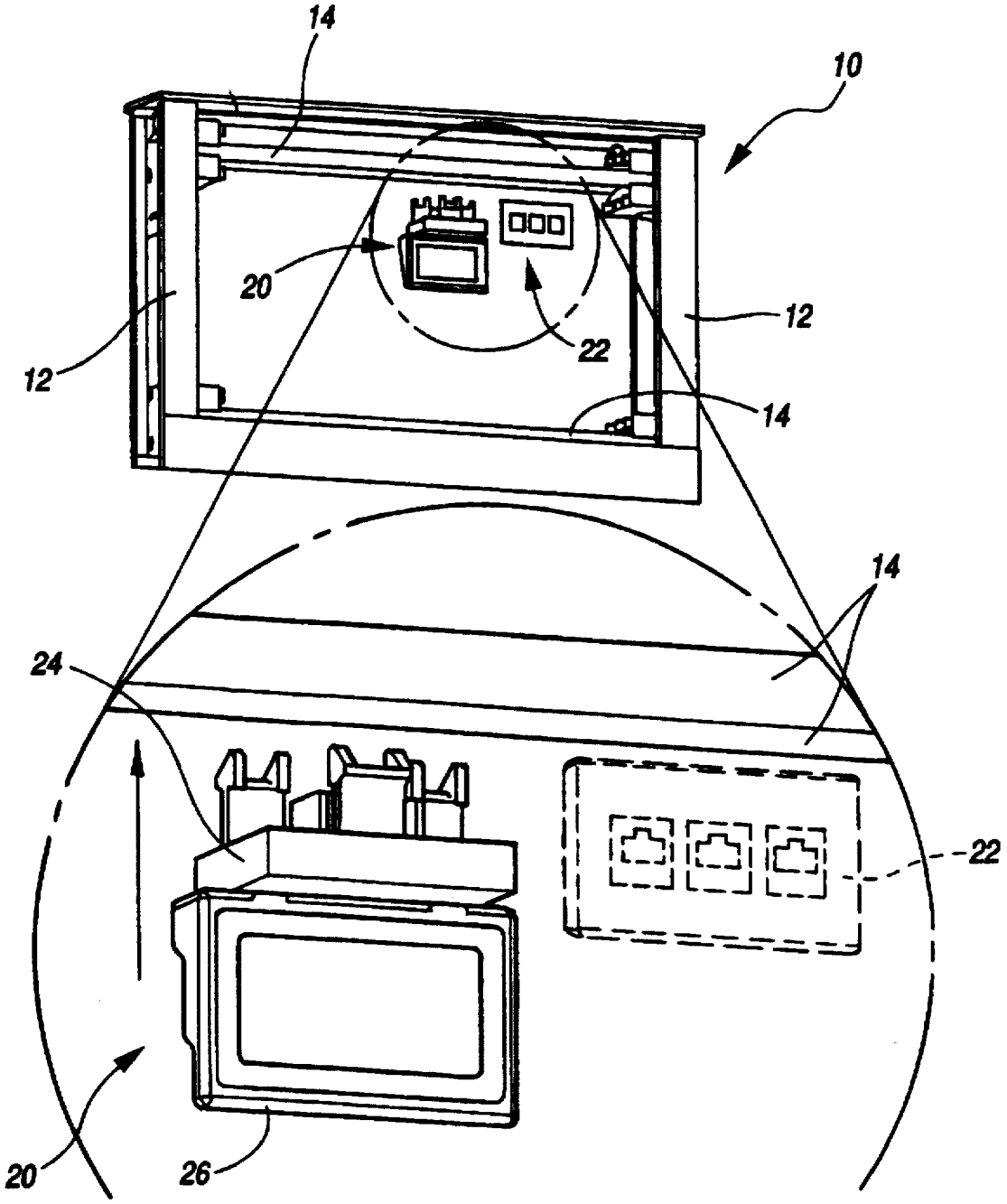
FIG. 1 is a perspective view of a modular office panel assembly showing in an enlarged portion the installation of a receptacle mounting device constructed in accordance with the principles of the invention.

Referring now to the drawings, and initially to FIG. 1, a modular office panel assembly is designated generally by the reference numeral 10 and includes vertical side frame members 12 interconnected by pairs of parallel spaced tubular cross-members 14. The panel assembly 10 is of the type generally known in the art and disclosed in Raz, U.S. Pat. No. 5,219,406. In accordance with the invention, a mounting device 20 is provided for mounting a standard data plug receptacle 22. The receptacle 22 may be of a conventional type used to accept modular plugs from electronic equipment such as telephones, facsimiles, computers and the like, and they are manufactured, for example, by American Telephone and Telegraph Company. The mounting device 20 includes as its basic components a mounting block 24 and a face plate or frame 26.

Figure 2:
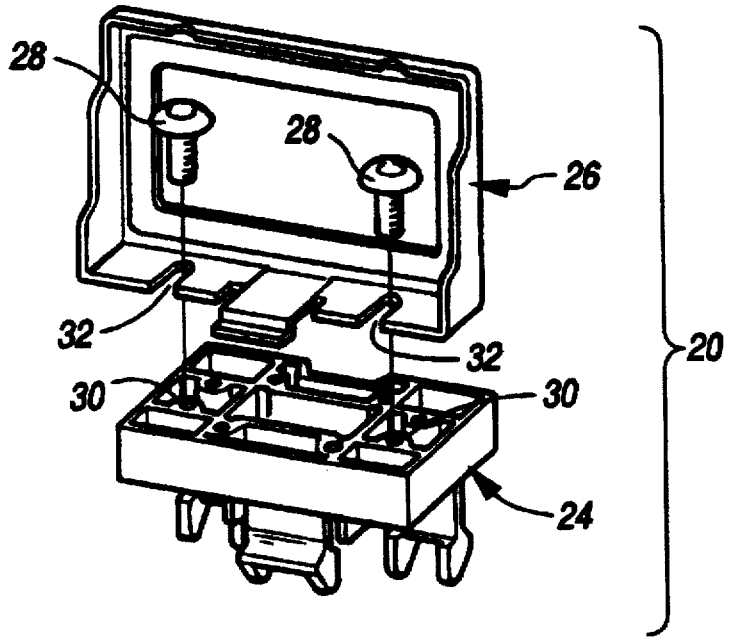
FIG. 2 is an exploded perspective view of the receptacle mounting device.
Figure 3:
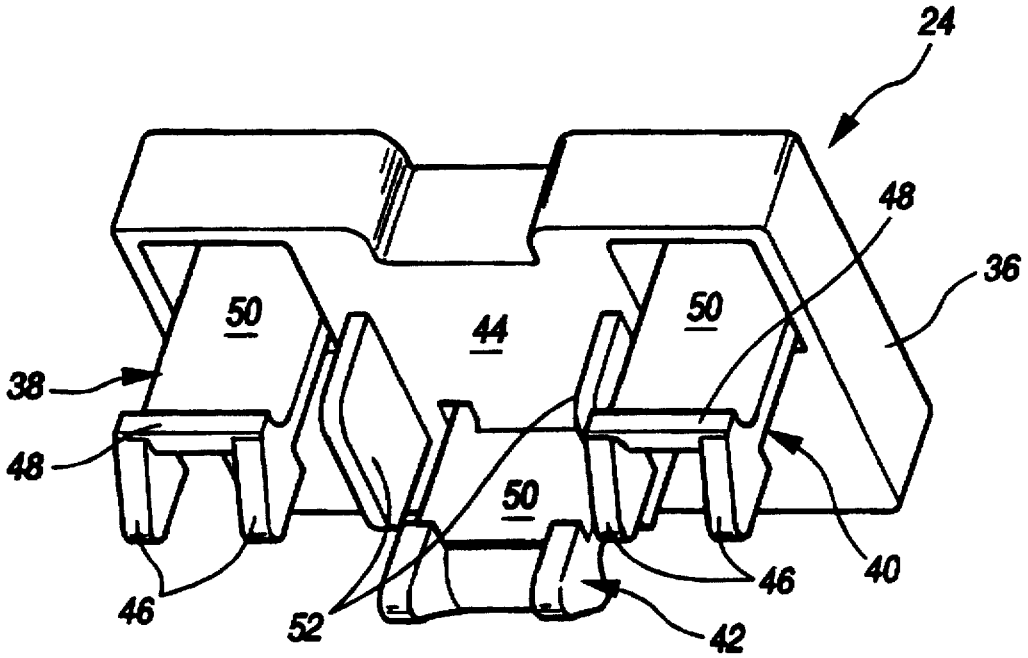
FIG. 3 is a first side perspective view of the mounting block of the receptacle mounting device.

As best seen in FIG. 2, the mounting block 24 and frame 26 are separate pieces connected by suitable screws 28 received by blind holes 30 provided in the mounting block 24. Preferably, the mounting block 24 and frame 26 are each integrally molded from a suitable relatively rigid plastic material. Slots 32 are formed in the frame 26 to receive the screws 28. In preferred form, the screws 28 may be of a self-tapping type as to form their own threads in the holes 30.

Figure 4:
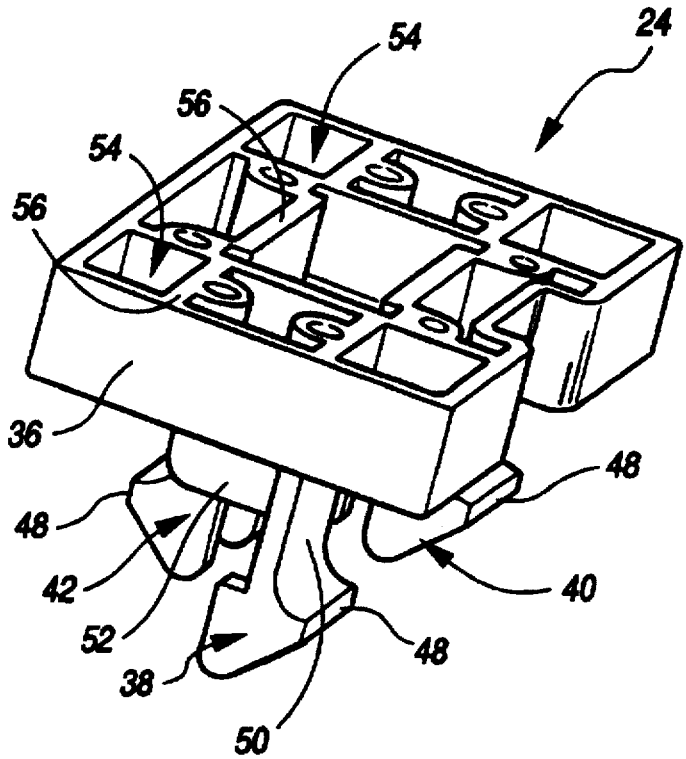
FIG. 4 is a second side perspective view of the mounting block.
Figure 5:
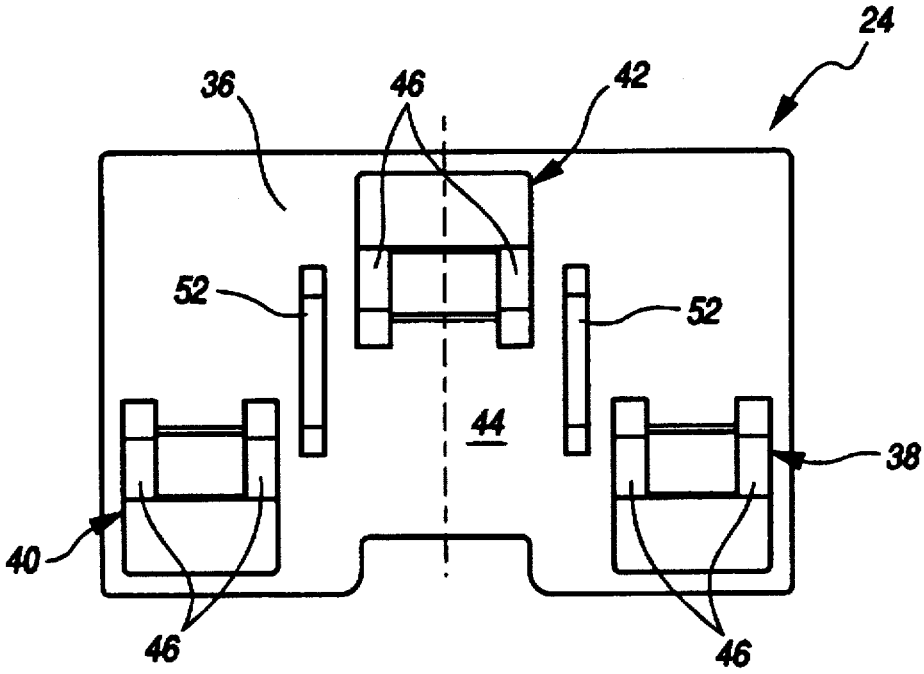
FIG. 5 is a plan view of the mounting block.
Figure 6:
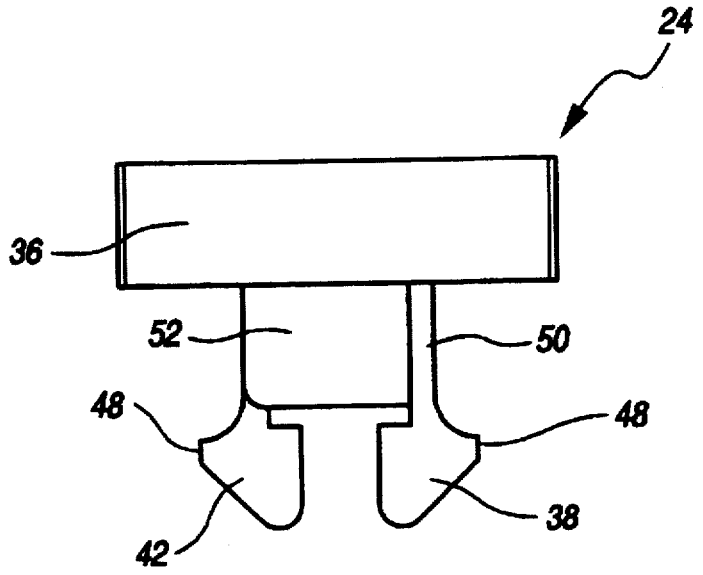
FIG. 6 is a side elevational view of the mounting block.

The details of the mounting block 24 may be seen in FIGS. 3–6. A principal component of the mounting block 24 is a body portion 36. Preferably, three latch arms 38, 40 and 42 extend at right angles from one side 44 of the body portion 36. Two of the latch arms 38 and 40 have ramp-like inclined surfaces 46 at their distal ends projecting laterally outwardly from the center of the mounting block 24 in a first direction. These two latch arms 38 and 40 are spaced from one another in a line running parallel to the longitudinal axis of the mounting block 24. The third latch arm 42 is positioned approximately centrally of the first two latch arms 38 and 40 near the center of side 44 of the body portion 36. Like the arms 38 and 40, this third arm 42 has inclined ramp-like surfaces 46 at its distal end which project laterally outwardly from the center of the mounting block 24 but in the opposite direction from the surfaces 46 of the first two arms 38 and 40. All of the ramp surfaces 46 terminate in end portions 48 which are spaced outwardly of planar portions 50 of the latch arms 38, 40 and 42. The planar portions 50 are relatively thin members and hence the latch arms 38, 40 and 42 have a degree of lateral resilience as to allow them to bend yet return to their original position. Also extending from side 44 of the body portion 36 are a pair of spaced walls 52, the purpose of which will be explained hereinafter. As best seen in FIG. 4, the side of the body portion 36 opposite the latch arms 38, 40 and 42 is formed with a plurality of cavities 54 defining a series of ribs or walls 56. This construction reduces the material content of the block 24 and thus decreases its cost while aiding in molding of the block 24 by avoiding undesirable shrinkage.

Figure 7:
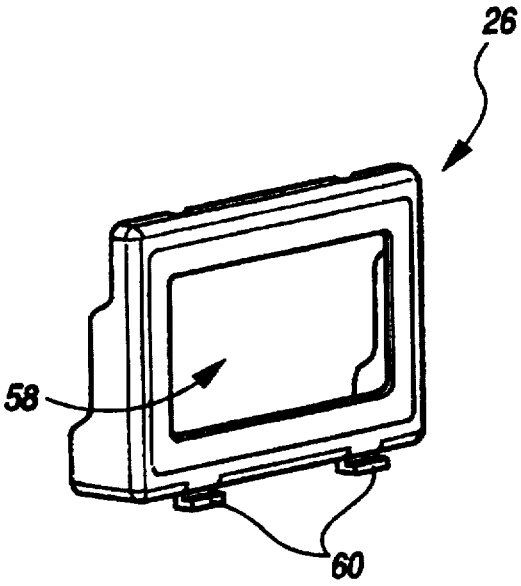
FIG. 7 is a front perspective view of the frame member of the mounting device.
Figure 8:
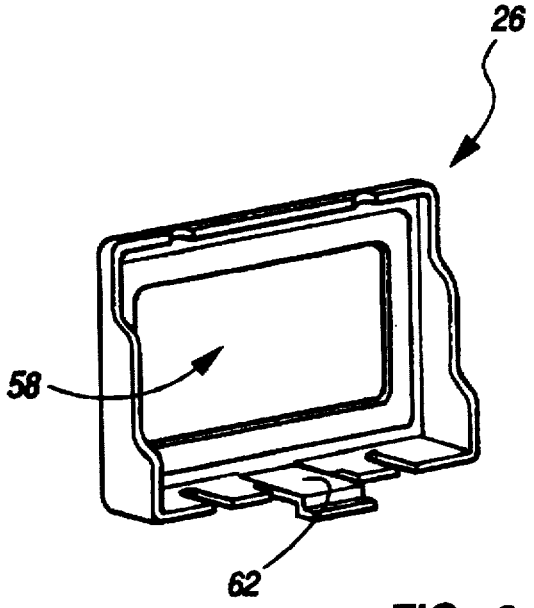
FIG. 8 is a rear perspective view of the frame member.

Turning now to FIGS. 7 and 8, the details of the face plate or frame 26 can be seen. The frame 26 generally has a large central opening 58 which is dimensioned and configured to receive the aforesaid receptacle 22. Typically, these standard receptacles 22 are provided with latch members at their edges which will allow the receptacles 22 to snap into the frame 26 and be securely retained in the opening 58. In accordance with the invention, the base of the frame 26 is formed with a pair of forwardly facing ears 60 and a rearwardly directed latch arm 62 for reasons which will be explained in detail hereinafter.

It can now be appreciated, particularly from FIG. 1, that the mounting device 20 of the present invention affords a convenient and highly cost effective means for mounting a typical data or communications receptacle 22 within the interior of a modular panel assembly 10 of the type having spaced tubular cross-members 14 as part of the panel 10 framework. The mounting block 24 with face plate or frame 26 attached may simply be manually snapped between a pair of tubular members 14 at any desired position along the length of the tubular members 14. The latch arms 38, 40 and 42 are sufficiently resilient such that the inclined surfaces 46 of the arms 38, 40 and 42 force the arms 38, 40 and 42 to bend inwardly of the mounting block 24 and expand outwardly as the end portions 48 pass around the tubes 14. Once the mounting block 24 is installed, the spaced walls 52, which have a width approximately equal to the lateral distance between the tube members 14, abut the sides of the tubes 14 and maintain proper tube 14 spacing.

Figure 9:
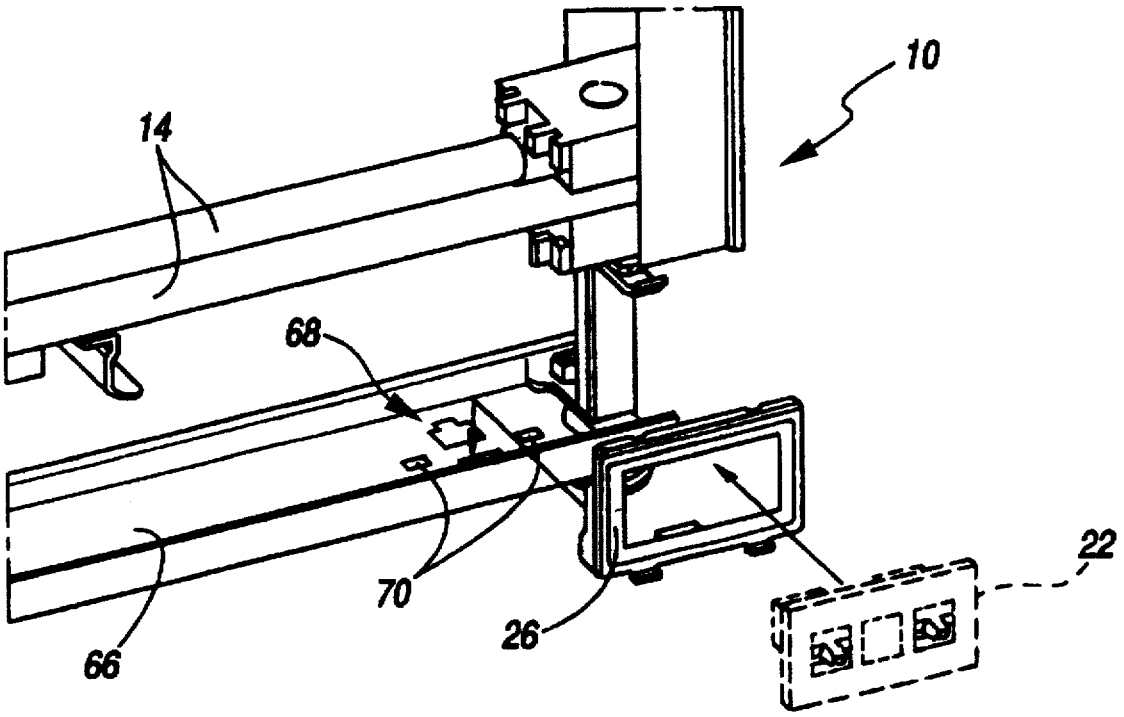
FIG. 9 is an exploded front perspective view of the frame member as separately installed along the bottom base rail channel of a modular office panel.
Figure 10:
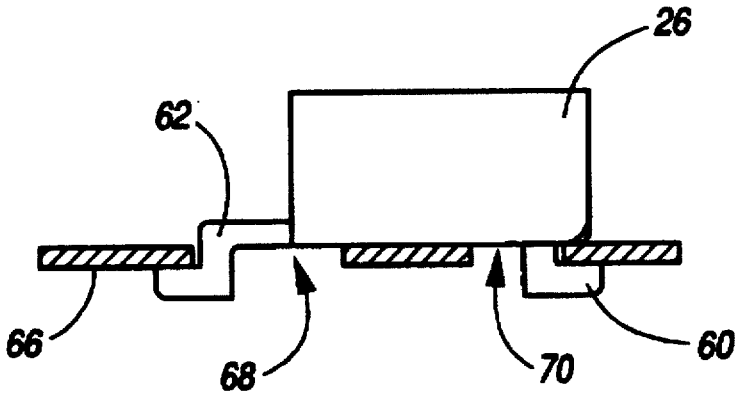
FIG. 10 is a fragmentary side cross-sectional view of the frame member as installed in accordance with FIG. 9.

An important feature of the invention is that the frame 26 is designed with the ears 60 and latch arm 62 such that none of these members interferes with the attachment of the frame 26 to the mounting block 24. However, as best seen in FIGS. 9 and 10, the frame 26 may be used separately of the mounting block 24 to support a receptacle 22 along a bottom channel 66 of the panel assembly 10. To facilitate this mounting, a first slot 68 is formed in the channel 66 to receive the latch arm 62 and a second pair of slots 70 are also formed in the channel 66 to receive the ears 60. The frame 26 may thereby be conveniently snapped into the slots 68 and 70 and be securely retained in mounted position on the channel 66, as shown in FIG. 10. A suitable bottom cover or kick plate (not shown) preferably covers the bottom of the panel 10. The dimensional thickness of the panels into which items 24 and 26, or item 26 alone, can be positioned is sufficient to allow cables and patch cords to be routed horizontally and vertically through the interior of the panel, exiting the panel to electronic equipment through a flexible vinyl strip located at the bottom of the panel tile and located immediately above a work space.

Although the invention has been described in connection with preferred embodiments thereof, it will be apparent to those skilled in the art that many changes and modifications may be made without departing from the true spirit and scope of the invention. Accordingly, it is intended by the appended claims to cover all such changes and modifications as come within the spirit and scope of the invention.

What is claimed is:

1. A device for supporting a data receptacle within a modular office partition panel wherein the panel comprises rigid frame members interconnected by pairs of closely spaced parallel tube members, the device comprising a body portion having a first side facing in a first direction and a second side facing in a direction opposite said first direction and having a longitudinal centerline;

at least two spaced latch arm members extending at right angles from said first side of said body portion, said latch arm members each having an inclined edge defining a ramp surface directed generally outwardly from the longitudinal centerline of said body portion in a third direction;

at least a third latch arm member extending at right angles from said first side of said body portion, said third latch arm member having an inclined edge directed generally outwardly from the longitudinal centerline of said body portion in a direction opposite said third direction;

said latch arm members being formed integrally with said body portion and each having a resilient arm portion;

a frame member dimensioned and configured to support a data receptacle; and means for mounting said frame member to said second side of said body portion;

wherein said latch arm members are configured to snap into and lock to two parallel adjacent tube members of an office partition panel and thereby support a receptacle within said panel.

2. The device of claim 1 wherein said frame extends at right angles from said second side of said body portion.

3. The device of claim 1 wherein at least one wall projects at right angles from said first side of said body portion and said wall is dimensioned and configured to fit closely between said two parallel adjacent tube members and thereby maintain a predetermined spacing of said tube members when said device is installed thereon.

4. The device of claim 1 wherein said body portion is provided with blind holes and said frame member is attached to said body portion by screws received in said blind holes.

5. The device of claim 1 wherein said frame member includes means for separately mounting said frame member to a frame member of said panel independently of said body portion.

6. The device of claim 1 wherein a second side of said body portion is provided with a plurality of cavities.

7. The device of claim 5 wherein said mounting means includes a latch and at least one ear projecting from a base portion of said frame member.

8. The device of claim 7 wherein said latch and said at least one ear are receivable within slots formed in said panel frame member.

* * * * *